United States Patent [19]

von der Eltz

[11] Patent Number: 4,820,312

[45] Date of Patent: Apr. 11, 1989

[54] PROCESS FOR DYEING TEXTILES MADE OF POLYESTER FIBER/WOOL BLENDS ON JET-DYEING MACHINES

[75] Inventor: Hans-Ulrich von der Eltz, Frankfurt am Main, Fed. Rep. of Germany

[73] Assignee: Hoechst Aktiengesellschaft, Frankfurt am Main, Fed. Rep. of Germany

[21] Appl. No.: 90,162

[22] Filed: Aug. 27, 1987

[30] Foreign Application Priority Data

Aug. 30, 1986 [DE] Fed. Rep. of Germany ..... 3629576

[51] Int. Cl.[4] ..... D06P 3/82; D06B 3/28

[52] U.S. Cl. ..... 8/533; 8/149.2; 8/149.3

[58] Field of Search ..... 8/149.1, 149.2, 149.3, 8/533; 68/5 C, 178

[56] References Cited

U.S. PATENT DOCUMENTS

| | | | |
|---|---|---|---|
| 3,681,005 | 8/1972 | von der Eltz et al. | 8/613 |
| 3,966,406 | 6/1976 | Namiki et al. | 8/636 |
| 3,973,902 | 8/1976 | Zimmermann et al. | 8/21 C |
| 4,125,371 | 11/1978 | Beutler et al. | 8/176 |
| 4,351,076 | 9/1982 | von der Eltz | 8/149.2 |
| 4,483,032 | 11/1984 | Christ et al. | 8/149.1 |
| 4,629,465 | 12/1986 | Hasler et al. | 8/539 |

FOREIGN PATENT DOCUMENTS 0078022 2/1986 European Pat. Off. .

*Primary Examiner*—Paul Lieberman
*Assistant Examiner*—John F. McNally

[57] ABSTRACT

Because the high dyeing temperatures employed necessitate the use of formaldehyde as customary wool-protecting agent and because of the resulting sealing problems on jet-dyeing machines, an HT dyeing of polyester fibre/wool blends cannot be carried out without polluting the environment. If, however, to achieve this purpose, lower temperatures are employed and the consequently required carriers are added directly to the dyeing liquor, this in turn gives rise to levelness problems and fastness reductions on the wool portion of the textile material.

It has now been found according to the invention that by metering the carrier under isothermal conditions into the dyeing after 10–20 minutes via the gas stream driving the textile material it is possible to obtain a homogeneous distribution thereof and its full effectiveness without fastness losses. The dyeing can be completed 10–30 minutes later. All the advantages of jet dyeing are fully retained in this process.

1 Claim, No Drawings

PROCESS FOR DYEING TEXTILES MADE OF POLYESTER FIBER/WOOL BLENDS ON JET-DYEING MACHINES

DESCRIPTION

The present invention relates to a process for the batchwise dyeing in jet-dyeing machines of textile material circulating therein in endless rope form and composed of linear polyester fibers in a blend with wool with dyes suitable for each of these fiber types by the exhaust dyeing technique, the forward feed for the transport of the textile material within the rinsed loop machine being effected via the actuation of the jet system by means of the kinetic energy of a circulating gas stream which is not inert with respect to the dyeing behavior of dyes and textile material, and at the same time the dyeing liquor being added in atomized form to this gas stream in the jet section for driving the textile material and thus, having been brought into contact with the textile material under the preselected temperature and pressure conditions, directly coming to impingement therein under fixing conditions.

The conjoint dyeing of the two constituents of polyester fiber/wool blends in an exhaust dyeing process is in itself common knowledge. To this end the wool portion of the textile material is customarily colored with acid, metal complex or reactive dyes, depending on the fastness requirements in the trade, the disperse dyes required for dyeing of the polyester fiber component usually being present in the same bath and frequently also being fixed simultenesouly. This fixing of the disperse dyes takes place either at the boil or at a temperature around 106° C. in the presence of carriers, or, alternatively, under high-temperature (HT) conditions (120°–125° C.) without the use of a carrier. However, the latter HTprocess for dye fixation requires in the case of the particular composition of the fiber blend to be dyed the addition of wool-protection agents. This is because in their absence the wool would be severely damaged owing to the high dyeing temperatures employed. The least costly effective wool-protecting agent in the present field has proved to be formaldehyde.

European Patent Specification No. EP-B-0,078,022, then, describes a wet treatment process, in particular for dyeing, wherein a gas stream in a jet-dyeing machine performs the function of advancing the rope form textile material to be finished, isothermal conditions being provided for carrying out the successive operations. The dyeing liquor is then metered into the driving gas stream and contacted under isothermal conditions with the material to be dyed. This system ensures rapid distribution of liquor in the material to be dyed, and also, at the same time, dyes start to become fixed on the respective fiber materials.

If blends of polyester fibers and wool are dyed, the liquor used for that purpose contains, in the aqueous medium used, dispersed or dissolved dyes for both fiber types and acid or buffer substances for setting a pH within the range of 4.6–6.5.

Polyester fibers are preferably hereinafter to be understood as meaning standard-dyeable types of this fiber category, i.e. those kinds of fibers which, as consequences of a modification of their homogeneous polymeric fiber structure, cannot anyhow be dyed at the boil without carrier.

If the above-described process of No.l EP-B-0,078,022 considered here for the one-bath dyeing of polyester fiber/wool blends is now to be carried out under high-temperature conditions, it has been found in this context that the use of formaldehyde as a wool-protecting agent, this use being necessary because of the given conditions, can lead to the operating personnel being exposed to a severe nuisance and possibly harm since the jet-dyeing machines used can be sealed off sufficiently tightly thereagainst only at an uneconomically high outlay. As a consequence, the difficulties which exist in this respect make it impossible to employ the HT dyeing process for the purpose in question.

Yet if the alternative process variant is contemplated for carrying out the said dyeing of the fiber blend, carrying out the exhaust dyeing operation at the boil or at a temperature around 106° C.requires carriers for the previously defined, unmodified polyester fiber type in order to be able to obtain a sufficient depth of shade on the textile material. However, the use of carriers directly in the dyeing liquor again presents in this case levelness problems and fastness reductions for the wool dyeing.

The invention described hereinafter thus had for its object to be able to dye polyester fiber/woodl blends at the boil or at a temperature around 106° C.in a jet-dyeing machine under isothermal conditions by an exhaust dyeing method while avoiding the abovementioned unacceptable shortcomings due to the presence of formaldehyde on the environment yet level and without the occurrence of fastness losses.

The object is achieved according to the invention by following the isothermal addition of a dyeing liquor containing the dyes for the two fiber types and pH-regulants by initially treating the textile material therewith at the boil or at a temperature around 106° C.for 10–20 minutes, only then metering the dispersion/emulsion of a carrier into the driving gas stream, and finally completing the dyeing in the course of a further 10–30 minutes under isothermal conditions.

The principle underlying the invention, namely the subsequent metering of the carrier emulsion into the driving gas stream, results not only in the achievement of the full carrier action but also in the elimination of fastness problems and levelness difficulties. This novel process produces perfectly level dyeings and, compared with the customary methods employed for the same purpose, results in savings in energy and chemicals and in a reduction in the output of waste waters.

The color yield on the two fiber types in the process is likewise improved, owing to the short liquor ratio employed, and the reduced fastness levels as a consequence of adding the carrier directly to the dyeing liquor in the initial stages of the treatment process are avoided.

In the claimed process, the wool portion can be dyed with any acid dye suitable for wool; to dye the polyester fiber portion, dyes which can be applied by carrier dyeing methods have to be selected from the class of the C.I. Disperse Dyes.

Suitable carries are commercially available dispersions or emulsion of substituted aromatics, for example chloroaromatics, phenols, salicylates and mixtures thereof which can also contain hydrocarbons and the like. Before use in the process according to the invention they are diluted with water and metered into the gas stream of the jet in such a way that they can become deposited on the textile material in the form of a fine mist.

The procedure for the claimed process accordingly takes approximately the following form:

After the jet-drying machine has been charged with the textile material made of polyester fibers and wool, the blower of the piece dyeing machine is set in operation and in this way the circulation of the material in rope form is brought about aerodynamically. In some instances even the loading process itself can advantageously be effected using the gas stream produced by the blower. By mixing steam into the transport gas stream not only is the textile material then heated up to a temperature of 100–106° C.together with the dyeing kier loaded therewith but at the same time a moistening of the circulating rope is brought about.

The separately prepared dye liquor is then metered into the hot gas stream via the injection pump serving the addition of treatment agent and a jet system present within the gas circulation system. This dye liquor contains dyes for the two fiber types and pH-regulants for setting a pH between 4.5 and 6.5 and any other auxiliaries; its temperature if 80°–100° C., so that the isothermal conditions on the textile material are only disturbed to a small extent, if at all, by the addition of the liquor, in particular since the amount of liquid is also kept as short as possible, to approximately 2–4 times the weight of pure fiber. The process of bleeding is effected in the course of a plurality of circulations of the textile material. This liquor is then left to act at 100°–106° C.for about 10–20 minutes on the circulating material to be dyed.

After expiry of this period, the metering in starts of the carrier preparation diluted with a little water (2–3 times the amount) at 60° C. The metering-in is effected in the same way as the addition of the liquor via a metering pump and the atomizer jet, distributed over at least one circulation of the textile material. After a further 10–30 minutes of treatment at 100°–106° C.the measures for the dyeing operation are concluded, and the after-treatment of the fiber blend thus dyed can take place in a conventional manner.

The examples which follow are not intended to restrict the claimed process in any way, especially not in respect of the dye combinations used, but merely serve to illustrate the procedure of the present invention. The percentages contained in these working examples are based on the weight of the articles thus designated and are calculated in relation to the dry state of the material to be dyed. The dyes mentioned are used in commercially available form and constitution.

EXAMPLE 1

A gaberdine comprising a wool/polyester fiber blend (in a ratio 45:55) is introduced in rope form into a jet-dyeing machine, and, by means of a steam/air mixture is set in circulation and at the same time moistened and preheated to 95° C. Thereafter the fabric has a moisture content of 50% resulting from condensed steam.

150% of additional moisture is then injected via the jet system in the form of a hot aqueous liquor at treatment temperature containing 2% of a buffer mixture of ammonium acetate and acetic acid for setting to pH 5 and also 3 g/l of a leveling agent based on the reaction product of 1 mol of stearylamine with 12 mol of ethylene oxide, followed in succession, dispersed or dissolved in a further 100% of added water at 95° C., the following colorants:

0.7% of the dye Disperse Yellow 64 having the C.I. No. 47023

0.655 of the dye Disperse Red 60 having the C.I. No. 60756, 0.6% of the dye Disperse Red 65 having the C.I. No. 11228, and 0.14% of the dye Disperse Blue 56 having the C.I. No. 63285, and 0.16% of the 1:2 chromium complex compound of the acid wool dye of the formula

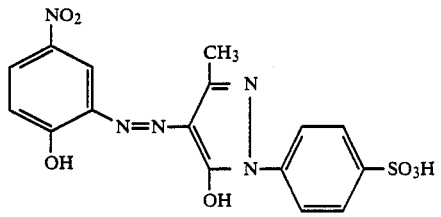

0.07% of the 1:2 chromium complex compound of the acid wool dye of the formula

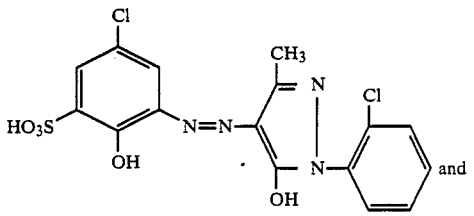

0.08% of a 1:2 metal complex compound prepared by mix-chroming from the two (in the ratio of 1:1) acid wool dyes of the formulae

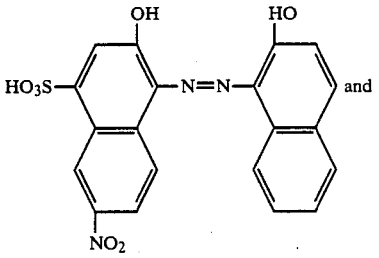

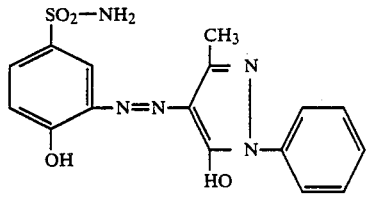

After charging of the dye-bath is complete the temperature of the circulating liquor is raised to 100° C. by blowing in steam, the textile material being dyed under these conditions for 20 minutes.

In the meantime, 0.9% of commercially available carrier based on methyl salicylate, in a mixture with aliphatic hydrocarbons, has been emulsified into 2–3 times the amount of water at 60° C. separately from the circulating liquor. After expiry of the previously mentioned 20 minute treatment period, this emulsion is metered into the jet-dyeing machine via the jet system and—while the material to be dyed circulates several times—is thus applied to the rope at 100° C.

After a further 20 minutes of dyeing at 100° C., the circulating treatment bath is dropped; the dyed material is then cooled down and at the same time rinsed by running less hot water into the dyeing jet and is subsequently aftertreated at 75° C. and a liquor ratio of 1:10 for 20 minutes with a freshly prepared aqueous bath containing 0.5% of acetic acid and 2 g/l of an auxiliary containing 40% of castor oil ethoxylated with 36 mol, 42% of Ca-phenylcoagasinulfonate and 16% of isopropanol.

Finally, the dyeing produced in the stated manner is again rinsed with hot and cold water and dried.

The result obtained is a gaberdine dyed a satisfactory tone-on-tone brown.

EXAMPLE 2

A fabric comprising a polyester fiber/wool blend (in a ratio of 55:45) is introduced in rope form into a jet-dyeing machine which permits isothermal dyeing in a gas stream and is then, by means of a steam/air mixture, set in circulation, heated up to 106° C. and at the same time impinged with 200% moisture formed by steam condensation.

Thereafter a further 20% of moisture is bled in through the injection jet system in the form of water at 95° C. containing 2% ammonium acetate 2% acetic acid (60% strength) and 1.5% of a leveling auxiliary based on the reaction product of 1 mol stearylamine with 12 mole of ethylene oxide and distributed over the textile material. All the time the temperature of the treatment bath is maintained at 106° C. After about 5 minutes, an additional 180% of moisture is applied to the material to be dyed in the same manner in the form of an aqueous liquor at 95° C. containing 0.06% of the dye Disperse Yellow 64 having the C.I. No. 47023, 0.875 of the dye Disperse Blue 56 having the C.I. No. 63285 and 1.4% of a blue disperse dye based on a mixture of differently containing less than 1 mol of bromine per mol of dye, and 10.04% of the reactive dye of the formula

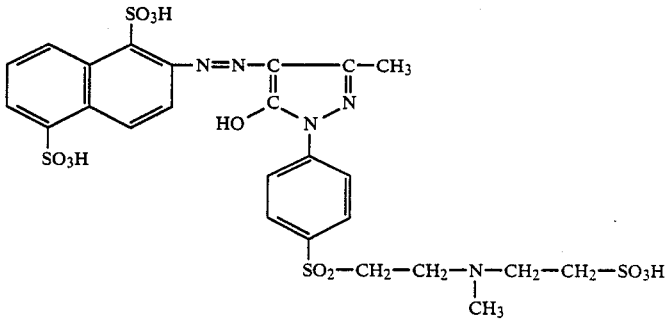

0.22% of the reactive dye of the formula

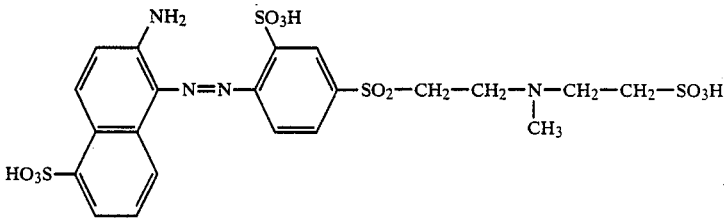

and 1.9% of the reactive dye of the formula

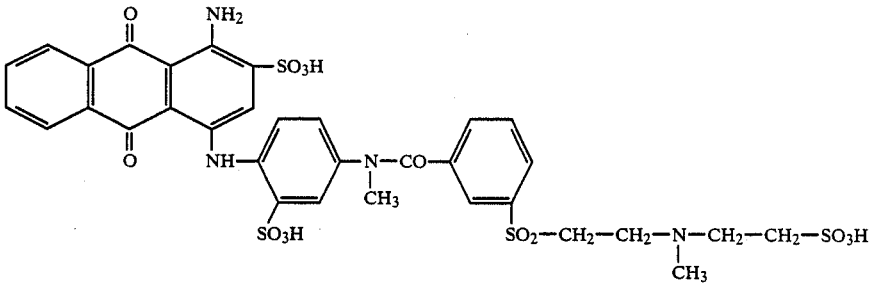

and the material to be dyed is then dyed at 106° C. for 20 minutes.

In the meantime, 0.9% of a commercially available carrier based on p-hydroxydiphenyl has been emulsified in 3 times the amount of water at 60° C. separately from the circulating liquor. After expiry of the 20-minute treatment period this emulsion is metered via the jet system into the jet-dyeing machine and—while the material to be dyed circulates several times—is applied to the same eat 106° C.

After a further 30 minutes of dyeing time at 106° C. and subsequent dropping of the dyeing liquor, less hot water is then run into the dyeing jet to cool down and at the same time rinse the dyed material, which is then aftertreated as in Example 1.

The result obtained is a satisfactory tone-on-tone and very fast navy dyeing of the fabric.

I claim:

1. In a process for the batchwise dyeing of textile material consisting of a fibrous mixture which is circulating in the form of an endless rope in a jet-dyeing machine, with aqueous liquors jointly containing dyes suitable for each of the particular fiber type by the exhaust dyeing technique, the forward feed for the transport of the textile rope within the closed loop machine via the actuation of the jet system being effected by means of the kinetic energy of a circulating gas stream which is not inert with respect to the coloristic behavior of dyes and fiber material, and to which at the same time, in the jet section for driving the textile rope, the dyeing liquor or a treatment agent formulation being added in an atomized form and thus, having been brought therein into contact with the fibrous material under the preselected temperature and pressure conditions, are allowed to act together directly in the fixing state, the improvement which comprises: selecting a textile material composed of linear polyester fibers in a blend with wool, and modifying the above procedure—in order to avoid evenness problems and fastness losses on the wool portion of the textile material, whilst the different dyestuff types being simultaneously fixed at the respective fiber portions of the blend, and without necessitating addition of formaldehyde or other wool-protecting agents—such that following the isothermal addition of the dyeing liquor containing the dyes for the two fiber types and pH-regulants into the driving gas stream the textile material is subsequently treated therewith at the boil or at a temperature around 106° C. for 10–20 minutes, only then metering into the driving gas stream the dispersion/emulsion of a carrier in an amount sufficient to secure liquor exhaustion as to the polyester-type dyestuff under boiling temperature conditions, the carrier substance comprising substituted aromatics, phenols or salicylates or mixtures thereof, optionally further containing hydrocarbons, and finally completing the dyeing in the course of a further 10–30 minutes treatment therewith under isothermal conditions.

* * * * *